US011846295B2

(12) United States Patent
Hayashi

(10) Patent No.: US 11,846,295 B2
(45) Date of Patent: Dec. 19, 2023

(54) TURBOCHARGER

(71) Applicant: IHI Corporation, Tokyo (JP)

(72) Inventor: Katsunori Hayashi, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/805,139

(22) Filed: Jun. 2, 2022

(65) Prior Publication Data

US 2022/0290682 A1 Sep. 15, 2022

Related U.S. Application Data

(63) Continuation of application No. PCT/JP2020/044714, filed on Dec. 1, 2020.

(30) Foreign Application Priority Data

Mar. 24, 2020 (JP) ..... 2020-053098

(51) Int. Cl.
*F01D 25/18* (2006.01)
*F04D 29/056* (2006.01)
(Continued)

(52) U.S. Cl.
CPC ..... *F04D 29/056* (2013.01); *F01D 25/16* (2013.01); *F01D 25/18* (2013.01);
(Continued)

(58) Field of Classification Search
CPC .. F04D 29/056; F04D 29/0563; F04D 29/063; F01D 25/16; F01D 25/18; F05D 2220/40; F05D 2260/602; F05D 2260/98
See application file for complete search history.

(56) References Cited

U.S. PATENT DOCUMENTS 4,480,440 A * 11/1984 Harper ..... F01D 25/18 417/407
8,008,194 B2 * 8/2011 Uchida ..... H01L 21/32134 438/655

(Continued)

FOREIGN PATENT DOCUMENTS

JP 5-321687 A 12/1993
JP 2012-237254 A 12/2012

(Continued)

OTHER PUBLICATIONS

International Search Report dated Jan. 26, 2021 in PCT/JP2020/044714, filed on Dec. 1, 2020, 2 pages.

*Primary Examiner* — Eldon T Brockman
*Assistant Examiner* — Andrew J Marien
(74) *Attorney, Agent, or Firm* — Oblon, McClelland, Maier & Neustadt, L.L.P.

(57) ABSTRACT

A turbocharger includes: an oil drainage path formed in a radial bearing support, one end of the oil drainage path being opened on at least one of a surface facing a thrust bearing and a surface facing a supported portion in the radial bearing support, the other end of the oil drainage path being opened on a bottom surface of the radial bearing support, an entire projected surface of the oil drainage path projected along a central axis thereof to an oil outlet being included within the oil outlet; and an oil drainage space provided between the thrust bearing and an impeller and connected to an oil chamber.

3 Claims, 3 Drawing Sheets

(51) Int. Cl.
*F04D 29/063* (2006.01)
*F04D 29/28* (2006.01)
*F01D 25/16* (2006.01)

(52) U.S. Cl.
CPC ..... *F04D 29/0563* (2013.01); *F04D 29/063* (2013.01); *F04D 29/284* (2013.01); *F05D 2220/40* (2013.01); *F05D 2260/602* (2013.01); *F05D 2260/98* (2013.01)

(56) References Cited

U.S. PATENT DOCUMENTS

| | | | | |
|---|---|---|---|---|
| 2010/0218499 | A1* | 9/2010 | Shibui | F02C 6/12 60/607 |
| 2014/0140865 | A1* | 5/2014 | Uneura | F16C 33/1045 417/365 |
| 2016/0115909 | A1* | 4/2016 | Begin | F04D 29/0513 60/605.3 |
| 2018/0135698 | A1* | 5/2018 | Toyota | F16C 33/7816 |
| 2018/0371985 | A1* | 12/2018 | Nambu | F01D 25/20 |

FOREIGN PATENT DOCUMENTS

| | | | |
|---|---|---|---|
| JP | 2013-79591 | A | 5/2013 |
| JP | 2014-66233 | A | 4/2014 |
| JP | 2014-101826 | A | 6/2014 |
| JP | 2015-48755 | A | 3/2015 |
| JP | 5807436 | B2 | 11/2015 |
| JP | 2019-178694 | A | 10/2019 |
| WO | WO 2017/014156 | A | 1/2017 |
| WO | WO 2017/170753 | A1 | 10/2017 |

* cited by examiner

TURBOCHARGER

CROSS REFERENCE TO RELATED APPLICATIONS

This application is a continuation application of International Application No. PCT/JP2020/044714, filed on Dec. 1, 2020, which claims priority to Japanese Patent Application No. 2020-053098 filed on Mar. 24, 2020, the entire contents of which are incorporated herein by reference.

BACKGROUND ART

Technical Field

The present disclosure relates to a turbocharger.

Patent Literature 1 discloses a turbocharger comprising a radial bearing and a thrust bearing in a bearing housing. A shaft is inserted into the radial bearing and the thrust bearing. The radial bearing rotatably supports the shaft. The radial bearing receives the radial load from the shaft. The thrust bearing receives the axial load from the shaft.

The bearing housing includes a lubricant path, an oil drainage path, an oil chamber, and an outlet. The lubricant path supplies a lubricant to the radial and thrust bearings. The oil drainage path directs a part of the lubricant after lubricating the radial and thrust bearings to the oil chamber. The outlet drains the lubricant in the oil chamber out of the bearing housing.

CITATION LIST

Patent Literature

Patent Literature 1: JP 5807436 B

SUMMARY

Technical Problem

In Patent Literature 1, a wall surface forming the oil chamber of the bearing housing is located on an extension of the oil drainage path. The lubricant passing through the oil drainage path moves along the extension of the oil drainage path, and hits the wall surface forming the oil chamber. When the lubricant hits the wall surface, the flow of the lubricant discharged from the outlet is disturbed. In such a case where the flow of lubricant is disturbed, it is difficult for the lubricant in the oil chamber to be discharged from the outlet, and the lubricant is likely to remain in the oil chamber. When the lubricant is likely to remain, the lubricant may leak from the bearing housing to a turbine side or to a compressor side.

The present disclosure aims to provide a turbocharger that can reduce leakage of lubricant.

Solution to Problem

To solve the above problem, the turbocharger according to the present disclosure includes: a radial bearing support including a bearing hole; a radial bearing provided in the bearing hole; a shaft inserted into the radial bearing; an impeller provided on the shaft; a thrust bearing into which the shaft is inserted, the thrust bearing being arranged between the radial bearing support and the impeller; a supported portion provided on the shaft and arranged between the radial bearing and the thrust bearing; an oil chamber formed below the radial bearing support and the thrust bearing; an oil outlet connected to the oil chamber and opening to an outside; an oil drainage path formed in the radial bearing support, one end of the oil drainage path being opened on at least one of a surface facing the thrust bearing and a surface facing the supported portion in the radial bearing support, the other end of the oil drainage path being opened on a bottom surface of the radial bearing support, an entire projected surface of the oil drainage path projected along a central axis thereof to the oil outlet being included within the oil outlet; and an oil drainage space provided between the thrust bearing and the impeller and connected to the oil chamber.

An entire projected surface of an opening of the oil drainage path on the bottom surface of the radial bearing support projected along the vertical direction to the oil outlet may be included within the oil outlet.

Effects of Disclosure

According to the present disclosure, leakage of lubricant can be reduced.

DESCRIPTION OF EMBODIMENTS

Embodiments of the present disclosure will be described in detail below with reference to the accompanying drawings. Specific dimensions, materials, and numerical values described in the embodiments are merely examples for a better understanding, and do not limit the present disclosure unless otherwise specified. In this specification and the drawings, duplicate explanations are omitted for elements having substantially the same functions and configurations by assigning the same sign. Furthermore, elements not directly related to the present disclosure are omitted from the figures.

Figure 1:
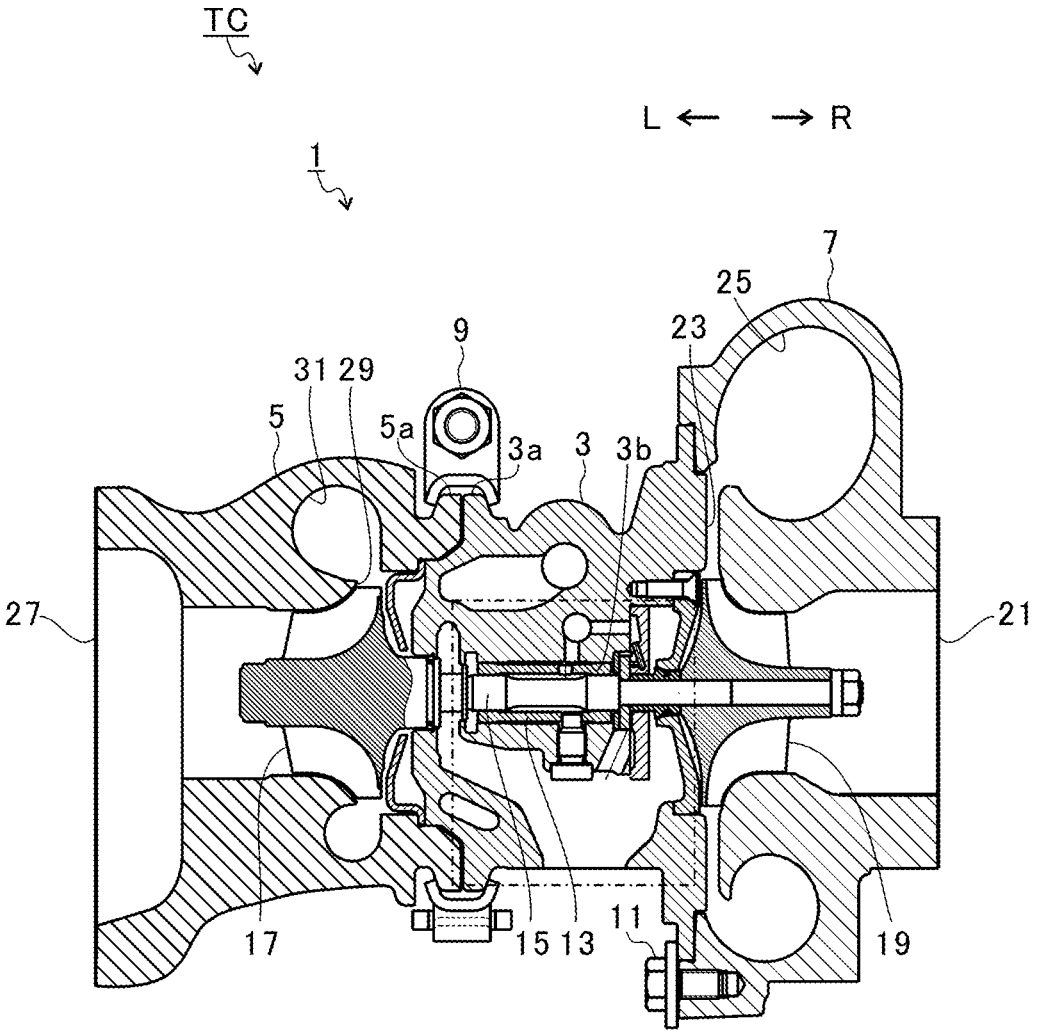
FIG. 1 is a schematic cross-sectional view of a turbocharger.

FIG. 1 is a schematic cross-sectional view of a turbocharger TC. Hereinafter, a direction indicated by an arrow L in FIG. 1 is explained as a left side of the turbocharger TC. A direction indicated by an arrow R in FIG. 1 is explained as a right side of the turbocharger TC. As shown in FIG. 1, the turbocharger TC comprises a turbocharger body 1. The turbocharger body 1 includes a bearing housing 3, a turbine housing 5, and a compressor housing 7. The turbine housing 5 is connected to the left side of the bearing housing 3 by a fastening mechanism 9. The compressor housing 7 is connected to the right side of the bearing housing 3 by fastening bolts 11.

A protrusion 3*a* is provided on an outer surface of the bearing housing 3. The protrusion 3*a* is provided on a side closer to the turbine housing 5. The protrusion 3*a* protrudes in a radial direction of the bearing housing 3. A protrusion 5*a* is provided on an outer surface of the turbine housing 5. The protrusion 5*a* is provided on a side closer to the bearing housing 3. The protrusion 5*a* protrudes in a radial direction of the turbine housing 5. The bearing housing 3 and the turbine housing 5 are banded to each other by the fastening mechanism 9. The fastening mechanism 9 includes, for example, a G-coupling. The fastening mechanism 9 clamps the protrusions 3*a*, 5*a*.

A bearing hole 3*b* is formed in bearing housing 3. The bearing hole 3*b* penetrates in the left-to-right direction of the turbocharger TC. A radial bearing 13 is arranged in the bearing hole 3*b*. In FIG. 1, a semi-floating bearing is shown as an example of the radial bearing 13. However, the radial bearing 13 may be any other radial bearing, such as a full floating bearing or a rolling bearing. A shaft 15 is inserted into the radial bearing 13. The radial bearing 13 rotatably supports the shaft 15. A turbine impeller 17 is provided at the left end of the shaft 15. The turbine impeller 17 is rotatably accommodated in the turbine housing 5. A compressor impeller (impeller) 19 is provided at the right end of shaft 15. The compressor impeller 19 is rotatably accommodated in the compressor housing 7.

An inlet 21 is formed in the compressor housing 7. The inlet 21 opens to the right side of the turbocharger TC. The inlet 21 is connected to an air cleaner (not shown). A diffuser flow path 23 is formed by opposing surfaces of the bearing housing 3 and the compressor housing 7. The diffuser flow path 23 pressurizes air. The diffuser flow path 23 is formed in an annular shape. The diffuser flow path 23 is connected to the inlet 21 through the compressor impeller 19 at an inner part in a radial direction of the shaft 15.

The compressor housing 7 is provided with a compressor scroll flow path 25. The compressor scroll flow path 25 is formed in an annular shape. The compressor scroll flow path 25 is located, for example, outside the diffuser flow path 23 in the radial direction of the shaft 15. The compressor scroll flow path 25 is connected to an engine intake (not shown) and the diffuser flow path 23. When the compressor impeller 19 rotates, air is sucked into the compressor housing 7 from the inlet 21. The intake air is pressurized and accelerated while passing through blades of the compressor impeller 19. The pressurized and accelerated air is further pressurized in the diffuser flow path 23 and the compressor scroll flow path 25. The pressurized air is directed to the engine intake.

An outlet 27 is formed in the turbine housing 5. The outlet 27 opens to the left side of the turbocharger TC. The outlet 27 is connected to an exhaust gas purifier (not shown). A connecting path 29 and a turbine scroll flow path 31 are formed in the turbine housing 5. The turbine scroll flow path 31 is formed in an annular shape. The turbine scroll flow path 31 is, for example, located outside the connecting path 29 in the radial direction of the shaft 15. The turbine scroll flow path 31 is connected to a gas inlet (not shown). Exhaust gas discharged from an engine exhaust manifold (not shown) is directed to the gas inlet. The connecting path 29 connects the turbine scroll flow path 31 with the outlet 2 through the turbine impeller 17. The exhaust gas led from the gas inlet to the turbine scroll flow path 31 is led to the outlet 27 through the connecting path 29 and the turbine impeller 17. The exhaust gas led to the outlet 27 rotates the turbine impeller 17 while passing therethrough.

The rotational force of the turbine impeller 17 is transmitted to the compressor impeller 19 via the shaft 15. As the compressor impeller 19 rotates, the air is pressurized as described above. As such, the air is directed to the engine intake.

Figure 2:
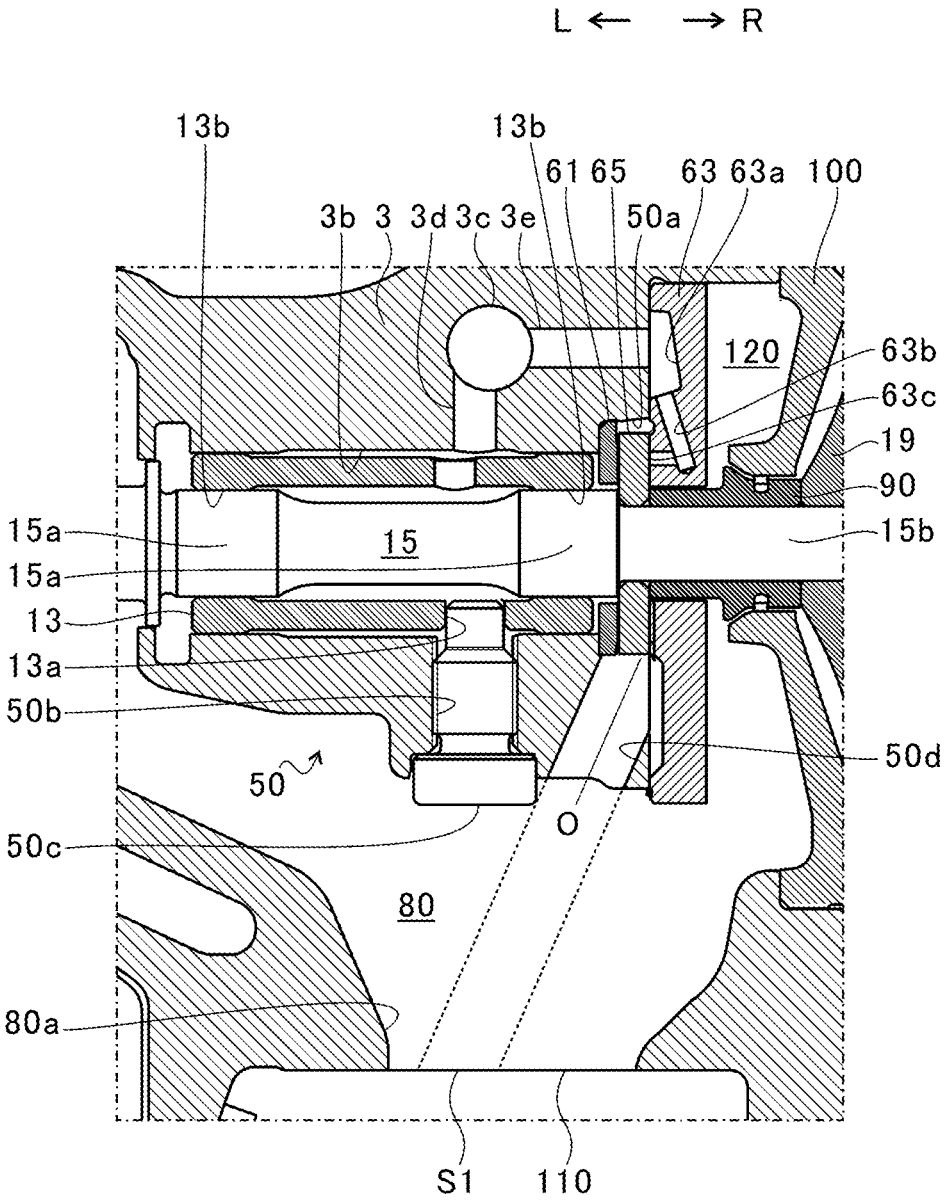
FIG. 2 is a first extract of an area enclosed by dashed-dotted lines in FIG. 1.

FIG. 2 is a first extract of an area enclosed by dashed-dotted lines in FIG. 1. As shown in FIG. 2, the bearing housing 3 includes a radial bearing support 50. A bearing hole 3*b* is formed in the radial bearing support 50. A radial bearing 13 is provided inside the radial bearing support 50 (bearing hole 3*b*). The radial bearing support 50 accommodates the radial bearing 13. The radial bearing support 50 holds the radial bearing 13.

The radial bearing support 50 includes a recess 50*a* at the end closer to the compressor impeller 19. The recess 50*a* is located closer the compressor impeller 19 with respect to the radial bearing 13. The recess 50*a* has a substantially annular shape. A central axis of the recess 50*a* is substantially equal to a central axis of the bearing hole 3*b*. The inner diameter of the recess 50*a* is larger than the inner diameter of the bearing hole 3*b*.

A pin hole 50*b* is formed in the radial bearing support 50. The pin hole 50*b* is formed vertically lower than the radial bearing 13. The pin hole 50*b* penetrates the radial bearing support 50 in the radial direction of the shaft 15 (hereinafter simply referred to as the radial direction). The pin hole 50*b* extends, for example, vertically downward. A positioning pin 50*c* is press-fitted into the pin hole 50*b*. An insertion hole 13*a* is formed in the radial bearing 13 at a position radially facing the pin hole 50*b*. An end of the positioning pin 50*c* is inserted into the insertion hole 13*a*. The positioning pin 50*c* restricts movements of the radial bearing 13 in the rotational direction and in the axial direction of the shaft 15 (hereinafter simply referred to as the axial direction).

Bearing surfaces 13*b* that receive a radial load from the shaft 15 are formed on the inner surface of the radial bearing 13. In this embodiment, two bearing surfaces 13*b* axially spaced apart from each other are provided in the radial bearing 13. Inner diameters of the two bearing surfaces 13*b* are substantially equal to each other. The inner diameters of the two bearing surfaces 13*b* are substantially constant.

The shaft 15 includes large-diameter portions 15*a* and a small-diameter portion 15*b*. The large-diameter portions 15*a* are arranged at positions so as to face the bearing surface 13*b* of the radial bearing 13 in the radial direction. In this embodiment, since the radial bearing 13 includes the two bearing surfaces 13*b* axially spaced apart from each other, the shaft 15 includes two large-diameter portions 15*a* axially spaced apart from each other. The two large-diameter portions 15*a* have a substantially cylindrical shape. Outer diameters of the two large-diameter portions 15*a* are substantially equal to each other. The outer diameters of the two large-diameter portions 15*a* are slightly smaller than the inner diameters of the two bearing surfaces 13*b*. The outer diameters of the two large-diameter portions 15*a* are substantially constant.

The small-diameter portion 15*b* is arranged closer to the compressor impeller 19 with respect to the two large-diameter portions 15*a*. The small-diameter portion 15*b* has a substantially cylindrical shape. An outer diameter of the small-diameter portion 15*b* is substantially constant. The outer diameter of the small-diameter portion 15*b* is smaller than that of the large-diameter portion 15*a*. Accordingly, a step is formed between the large-diameter portion 15*a* and the small-diameter portion 15*b*.

The bearing housing 3 is provided with a turbine side thrust ring 61, a compressor side thrust ring (thrust bearing) 63, and a thrust collar (supported portion) 65. The turbine side thrust ring 61, the compressor side thrust ring 63, and the thrust collar 65 are arranged between the radial bearing support 50 and the compressor impeller 19. The turbine side thrust ring 61, the compressor side thrust ring 63, and the thrust collar 65 are arranged closer to the compressor impeller 19 with respect to the radial bearing 13. However, the turbine side thrust ring 61, the compressor side thrust ring 63, and the thrust collar 65 may be arranged closer to the turbine impeller 17 (see FIG. 1) with respect to the radial bearing 13. The shaft 15 is inserted into the turbine side thrust ring 61, the compressor side thrust ring 63, and the thrust collar 65.

The turbine side thrust ring 61 is arranged closer to the turbine impeller 17 (FIG. See 1) in the recess 50*a*. The turbine side thrust ring 61 has a substantially annular shape. The turbine side thrust ring 61 is attached to the bearing housing 3 (radial bearing support 50). The turbine side thrust ring 61 is non-rotatably held by the radial bearing support 50. The large-diameter portion 15*a* of the shaft 15 is inserted into the turbine side thrust ring 61. An inner diameter of the turbine side thrust ring 61 is larger than the outer diameter of the large-diameter portion 15*a*. Furthermore, an outer diameter of the turbine side thrust ring 61 is smaller than the inner diameter of the recess 50*a*.

The compressor side thrust ring 63 is located closer to the compressor impeller 19 with respect to the recess 50*a*. The compressor side thrust ring 63 is arranged adjacent to the radial bearing support 50. The compressor side thrust ring 63 has a substantially annular shape. The compressor side thrust ring 63 is attached to the bearing housing 3 (radial bearing support 50). The compressor side thrust ring 63 is non-rotatably held by the radial bearing support 50. The small-diameter portion 15*b* of the shaft 15 is inserted into the compressor side thrust ring 63. An inner diameter of the compressor side thrust ring 63 is larger than the outer diameter of the small-diameter portion 15*b*. Furthermore, an outer diameter of the compressor side thrust ring 63 is larger than the outer diameter of the turbine side thrust ring 61 (the inner diameter of the recess 50 A).

A groove 63*a* and a path 63*b* are formed in the compressor side thrust ring 63. The groove 63*a* is formed in the compressor side thrust ring 63 at a surface closer to the turbine impeller 17 (see FIG. 1). The path 63*b* is located radially inside the groove 63*a*. The path 63*b* includes an exit end 63*c* opened on the surface closer to the turbine impeller 17 in the compressor side thrust ring 63. The path 63*b* is connected to an inner surface of the groove 63*a* at one end, and connected to the exit end 63*c* at the other end.

In the recess 50*a*, the thrust collar 65 is located closer to the compressor impeller 19. The thrust collar 65 is located between the turbine side thrust ring 61 (radial bearing 13) and the compressor side thrust ring 63. The thrust collar 65 has a substantially annular shape. An inner diameter of the thrust collar 65 is substantially equal to the outer diameter of the small-diameter portion 15*b*, or slightly larger than the outer diameter of the small-diameter portion 15*b*. An outer diameter of the thrust collar 65 is smaller than the inner diameter of the recess 50*a*. The thrust collar 65 is provided adjacent to the step formed between the large-diameter portion 15*a* and the small-diameter portion 15*b* of the shaft 15. However, the thrust collar 65 is not an essential component. For example, instead of the thrust collar 65, a portion of the shaft 15 may be formed the same as an external shape of the thrust collar 65. In that case, the part of the shaft 15 functions as the "supported portion" in the same manner as the thrust collar 65.

For example, the thrust collar 65 is press-fitted onto the small-diameter portion 15*b*. Accordingly, the thrust collar 65 integrally rotates with the shaft 15. Furthermore, the thrust collar 65 integrally moves with the shaft 15 in the axial direction.

An oil path 3*c*, a vertical supply path 3*d*, and a horizontal supply path 3*e* are formed in the bearing housing 3. Lubricant is supplied to the oil path 3*c* from outside the bearing housing 3. The oil path 3*c* is connected to the vertical supply path 3*d* and the horizontal supply path 3*e*.

The vertical supply path 3*d* is connected to the oil path 3*c* at one end, and to the bearing hole 3*b* at the other end. The lubricant is led from the oil path 3*c* to the vertical supply path 3*d*. The vertical supply path 3*d* leads the lubricant to the bearing hole 3*b*.

The horizontal supply path 3*e* is connected to the oil path 3*c* at one end, and connected to the groove 63*a* of the compressor side thrust ring 63 at the other end. The lubricant is led from the oil path 3*c* to the horizontal supply path 3*e*. The horizontal supply path 3*e* leads the lubricant to the groove 63*a*.

The lubricant led to the groove 63*a* is led to the outlet end 63*c* that is an end of the path 63*b* through the path 63*b*. The outlet end 63*c* is opened on the compressor side thrust ring 63 at an area axially facing the thrust collar 65.

The lubricant led to the bearing hole 3*b* lubricates the radial bearing 13. A portion of the lubricant flows between the bearing surface 13*b* of the radial bearing 13 and the large-diameter portion 15*a* of the shaft 15. As a result, an oil film is formed between the bearing surface 13*b* and the large-diameter portion 15*a*. A radial load from the shaft 15 is supported by the oil film pressure of the lubricant. In other words, in the radial bearing 13, the bearing surface 13*b* radially facing the large-diameter portion 15*a* functions as the radial bearing surface that receives the radial load.

The lubricant lubricating the radial bearing surfaces moves in the axial direction (left-to-right in FIG. 2) within the radial bearing support 50. The lubricant moving in the left direction in FIG. 2 is led to an oil chamber 80. The oil chamber 80 is formed below the radial bearing support 50, the turbine side thrust ring 61, the compressor side thrust ring 63, and the thrust collar 65. The lubricant moving to the right direction in FIG. 2 moves to the turbine side thrust ring 61 and the thrust collar 65 in this order. The lubricant moving in the right direction in FIG. 2 lubricates between the turbine side thrust ring 61 and the thrust collar 65. The lubricant lubricating between the turbine side thrust ring 61 and the thrust collar 65 moves downward and to the right in FIG. 2.

Furthermore, the lubricant led to the groove 63*a* of the compressor side thrust ring 63 is discharged from the outlet end 63*c* through the path 63*b*. The lubricant discharged from the outlet end 63*c* lubricates between the compressor side thrust ring 63 and the thrust collar 65. The lubricant lubricating between the compressor side thrust ring 63 and the thrust collar 65 moves downward and to the right in FIG. 2. As such, the thrust collar 65 is supplied with lubricant from both sides in the axial direction. As a result, oil films are formed between the thrust collar 65 and the turbine side thrust ring 61, and between the thrust collar 65 and the compressor side thrust ring 63. The axial load from the thrust collar 65 (shaft 15) is supported by oil film pressure of the lubricant. In other words, in the turbine side thrust ring 61 and the compressor side thrust ring 63, the surfaces axially facing the thrust collar 65 function as thrust bearing surfaces receiving the thrust load.

An oil thrower 90 is arranged between the thrust collar 65 and the compressor impeller 19. The oil thrower 90 has a substantially cylindrical shape. The small-diameter portion 15*b* of the shaft 15 is inserted into the oil thrower 90. The oil thrower 90 integrally rotates with the shaft 15. The oil thrower 90 is arranged radially inside the compressor side thrust ring 63. The oil thrower 90 scatters the lubricant flowing along the shaft 15 toward the compressor impeller 19 radially outward.

On a rear side of the compressor impeller 19 (the left in FIG. 2), a seal plate 100 is arranged. The seal plate 100 is attached to the bearing housing 3. The seal plate 100 is non-rotatably held by the bearing housing 3. The seal plate 100 has a substantially annular shape. The small-diameter portion 15*b* of the shaft 15 and the oil thrower 90 are inserted into the seal plate 100. The seal plate 100 curbs leakage of the lubricant scattered by the oil thrower 90 toward the compressor impeller 19.

An oil drainage path 50*d* is formed in the radial bearing support 50. In the radial bearing support 50, the oil drainage path 50*d* is opened on at least one of a surface facing the compressor side thrust ring 63 and a surface facing the thrust collar 65 at one end, and opened on an outer surface (bottom surface) of the radial bearing support 50 at the other end. In the present embodiment, the oil drainage path 50*d* is a through hole penetrates between the inner surface of the recess 50*a* and the outer surface (bottom surface) of the radial bearing support 50. Therefore, the lubricant lubricating between the turbine side thrust ring 61 and the thrust collar 65 is led to the oil drainage path 50*d*. Furthermore, the lubricant lubricating between the thrust collar 65 and the compressor side thrust ring 63 is led to the oil drainage path 50*d*. The oil drainage path 50*d* has a substantially constant inner diameter. The opening of the oil drainage path 50*d* formed on the outer surface of the radial bearing support 50 is located between the positioning pin 50*c* (pin hole 50*b*) and the compressor side thrust ring 63.

A portion of the lubricant lubricating the turbine side thrust ring 61, the compressor side thrust ring 63 and the thrust collar 65 moves downward in FIG. In 2, and is led to the oil chamber 80 through the oil drainage path 50*d*. An oil outlet 110 is formed on a vertically lower side of the oil chamber 80. The oil outlet 110 is connected to the oil chamber 80 and opens to the outside of the bearing housing 3. The lubricant led to the oil chamber 80 falls under its own weight and is discharged to the outside of the bearing housing 3 through the oil outlet 110.

Furthermore, a portion of the lubricant lubricating the turbine side thrust ring 61, compressor side thrust ring 63 and thrust collar 65 moves to the right in FIG. 2, and is led to an oil drainage space 120. The oil drainage space 120 is defined between the compressor side thrust ring 63 and the seal plate 100 (compressor impeller 19). The oil drainage space 120 is continuous with the oil chamber 80 without the oil drainage path 50*d*. The lubricant led to the oil drainage space 120 is scattered by the oil thrower 90. The oil drainage space 120 leads the scattered lubricant through the oil chamber 80 to the oil outlet 110. The oil outlet 110 discharges the led lubricant to the outside of the bearing housing 3.

The oil drainage space 120 is formed opposite the oil drainage path 50*d* across the compressor side thrust ring 63. The oil drainage path 50*d* has an angle inclined toward a direction spaced apart from the oil drainage space 120 as vertically moving downward. By forming the oil drainage space 120 and the oil drainage path 50*d* separately at the different positions, the lubricant passing through the oil drainage space 120 and the lubricant passing through the oil drainage path 50*d* are less likely to merge (to be mixed). As a result, the discharge of lubricant can be improved.

If a wall surface 80*a* forming the oil chamber 80 of the bearing housing 3 is located on an extension of the oil drainage path 50*d*, the lubricant passing through the oil drainage path 50*d* hits the wall surface 80*a*. In such a case where the lubricant hits the wall surface, the flow of lubricant discharged from the oil outlet 110 is disturbed. When the flow of lubricant is disturbed, it is difficult for the lubricant in the oil chamber 80 to be discharged from the oil outlet 110, and the lubricant is likely to remain in the oil chamber 80. When the lubricant is likely to remain, the lubricant may leak from bearing housing 3 to the turbine side or to the compressor side.

Accordingly, in this embodiment, the angle of inclination of the oil drainage path 50*d* with respect to the horizontal plane is adjusted so that the wall surface 80*a* is not located on the extension of the oil drainage path 50*d*. As a result, the entire projected surface S1 of the oil drainage path 50*d* projected along a central axis O to the oil outlet 110 is included within the oil outlet 110. In the oil outlet 110, the projected surface S1 is located on a side spaced apart from the oil drainage space 120 (i.e., the left side in FIG. 2). The positioning pin 50*c* is not located on the extension of the oil drainage path 50*d*. In other words, the positioning pin 50*c* is located outside the area on the extension of the oil drainage path 50*d*.

This allows the lubricant moving along the central axis O of the oil drainage path 50*d* to be directly led to the oil outlet 110. The lubricant moving along the central axis O of the oil drainage path 50*d* is less likely to hit the wall surface 80*a*. Accordingly, the discharge of the lubricant at the oil outlet 110 can be improved. As a result, the bearing housing 3 can reduce leakage of lubricant.

In this embodiment, a tool is inserted from the oil outlet 110 when machining the oil drainage path 50*d*. This allows the inclination angle of the oil drainage path 50*d* with respect to the horizontal plane to be larger, compared to the case where the tool is inserted from an opening on a compressor side of the bearing housing 3.

If the tool is inserted from the opening on the compressor side of the bearing housing 3 to machine the oil drain path 50*d*, the tool interferes with an upper part of the bearing housing 3. Accordingly, it is difficult to adjust the angle of inclination of the oil drainage path 50*d* with respect to the horizontal plane so that the entire projected surface S1 of the oil drainage path 50*d* is included within the oil outlet 110.

In contrast, when the tool is inserted from the oil outlet 110 to machine the oil drainage path 50*d*, the tool does not interfere the upper part of the bearing housing 3. Accordingly, the angle of inclination of the oil drainage path 50*d* with respect to the horizontal plane can be easily adjusted so that the entire projected surface S1 of the oil drainage path 50*d* is included within the oil outlet 110.

Figure 3:
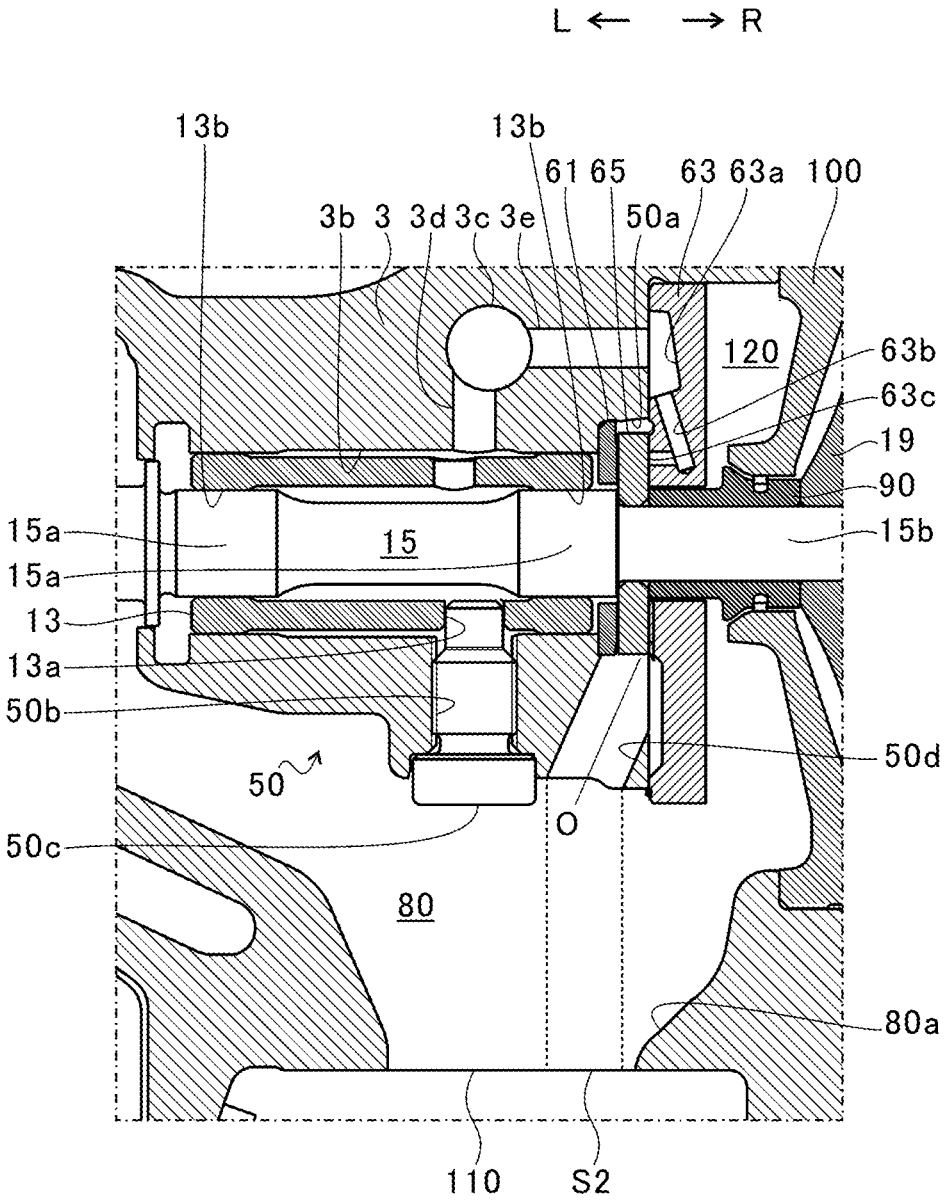
FIG. 3 is a second extract of the area enclosed by the dashed-dotted lines in FIG. 1.

FIG. 3 is a second extract of the area enclosed by the dashed-dotted lines in FIG. 1. As shown in FIG. 3, the entire projected surface S2 of the opening of the oil drainage path 50*d* on the outer surface (bottom surface) of the radial bearing support 50 projected along the vertical direction to the oil outlet 110 is included within the oil outlet 110.

This makes it difficult for the lubricant to hit the wall surface 80*a* even when falling vertically downward from the opening of the oil drainage path 50*d* on the outer surface. This improves the discharge of the lubricant from the oil outlet 110. As a result, the bearing housing 3 can reduce leakage of lubricant.

Although the embodiment of the present disclosure has been described above with reference to the accompanying drawings, the present disclosure is not limited thereto. It is obvious that a person skilled in the art can conceive of various examples of variations or modifications within the scope of the claims, which are also understood to belong to the technical scope of the present disclosure.

The above embodiment describes an example in which the entire projected surface S2 is included within the oil outlet 110. However, the present disclosure is not limited thereto, and the entire projected surface S2 may not be included within the oil outlet 110. For example, a part of the projected surface S2 may overlap with the wall surface 80*a*.

What is claimed is:

1. A turbocharger comprising:

a radial bearing support including a bearing hole;

a radial bearing provided in the bearing hole;

a shaft inserted into the radial bearing;

an impeller provided on the shaft;

a thrust bearing into which the shaft is inserted, the thrust bearing being arranged between the radial bearing support and the impeller;

a supported portion provided on the shaft and arranged between the radial bearing and the thrust bearing;

an oil chamber formed below the radial bearing support and the thrust bearing;

an oil outlet connected to the oil chamber and opening to an outside;

an oil drainage path formed in the radial bearing support, one end of the oil drainage path being opened on at least one of a surface facing the thrust bearing and a surface facing the supported portion in the radial bearing support, an other end of the oil drainage path being opened on a bottom surface of the radial bearing support, an entire projected surface of the oil drainage path projected along a central axis of the oil drainage path to the oil outlet being included within the oil outlet; and an oil drainage space provided between the thrust bearing and the impeller and connected to the oil chamber.

2. The turbocharger according to claim 1, wherein an entire projected surface of an opening of the oil drainage path on the bottom surface of the radial bearing support projected along a vertical direction to the oil outlet is included within the oil outlet.

3. The turbocharger according to claim 1, wherein the oil drainage path is a through hole passing through the radial bearing support and having a constant inner diameter.

* * * * *